US007926272B2

(12) United States Patent
Takemoto

(10) Patent No.: US 7,926,272 B2
(45) Date of Patent: Apr. 19, 2011

(54) EXHAUST GAS RECIRCULATION SYSTEM FOR INTERNAL COMBUSTION ENGINE

(75) Inventor: Eiji Takemoto, Obu (JP)

(73) Assignee: Denso Corporation, Kariya (JP)

( * ) Notice: Subject to any disclaimer, the term of this patent is extended or adjusted under 35 U.S.C. 154(b) by 657 days.

(21) Appl. No.: 11/950,805

(22) Filed: Dec. 5, 2007

(65) Prior Publication Data

US 2008/0141671 A1 Jun. 19, 2008

(30) Foreign Application Priority Data

Dec. 14, 2006 (JP) ..... 2006-336620

(51) Int. Cl.
*F02B 33/44* (2006.01)
*F02M 25/06* (2006.01)
*F02M 25/07* (2006.01)

(52) U.S. Cl. ..... 60/605.2; 60/278; 60/295; 123/568.12

(58) Field of Classification Search ..... 60/605.2, 60/295, 285–286; 123/568.12
See application file for complete search history.

(56) References Cited

U.S. PATENT DOCUMENTS 5,806,308 A * 9/1998 Khair et al. ..... 60/605.2
6,301,888 B1 * 10/2001 Gray, Jr. ..... 60/605.2
6,470,682 B2 * 10/2002 Gray, Jr. ..... 60/605.2
6,598,388 B2 * 7/2003 Lucas et al. ..... 60/311
6,622,480 B2 * 9/2003 Tashiro et al. ..... 60/295
6,851,258 B2 * 2/2005 Kawashima et al. ..... 60/295
6,918,251 B2 * 7/2005 Yanagisawa et al. ..... 60/605.2
6,952,918 B2 * 10/2005 Imai et al. ..... 60/295
6,988,365 B2 * 1/2006 Sasaki ..... 60/605.2
7,043,914 B2 * 5/2006 Ishikawa ..... 60/605.2
7,047,741 B2 * 5/2006 Gray, Jr. ..... 60/605.2
7,107,770 B2 * 9/2006 Shirakawa ..... 60/605.2
7,131,263 B1 * 11/2006 Styles ..... 123/568.12
7,178,326 B2 * 2/2007 Kojima et al. ..... 60/605.2
7,261,098 B2 * 8/2007 Vigild et al. ..... 60/605.2
7,296,561 B2 * 11/2007 Shirakawa et al. ..... 60/605.2

(Continued)

FOREIGN PATENT DOCUMENTS

EP 1 892 400 A2 * 2/2008

(Continued)

OTHER PUBLICATIONS

A Machine Translation of JP 05-187329 A, published on Jul. 27, 1993.*

*Primary Examiner* — Thai Ba Trieu
(74) *Attorney, Agent, or Firm* — Nixon & Vanderhye PC

(57) ABSTRACT

A low pressure EGR system includes a low pressure EGR passage connecting a downstream portion of an exhaust gas cleaner disposed in an exhaust passage to an upstream portion of a supercharger compressor disposed in an intake passage. A device for trapping foreign particles contained in EGR gas to be recirculated is disposed in the low pressure EGR passage. The trapping device may be positioned lower than the passage connected thereto so that foreign particles drop into the device by their own weight. A cross-sectional area of the trapping device may be made larger than that of the passage so that the flow speed of the EGR gas is reduced in the trapping device and the foreign particles are easily trapped. A valve for closing the low pressure EGR passage may be disposed therein to stop EGR when malfunctions are detected in the exhaust gas cleaner or the supercharger.

7 Claims, 4 Drawing Sheets

U.S. PATENT DOCUMENTS

| | | | | |
|---|---|---|---|---|
| 7,343,743 | B2 * | 3/2008 | Dismon et al. | 60/605.2 |
| 7,377,254 | B2 * | 5/2008 | Hergart et al. | 123/198 F |
| 7,469,181 | B2 * | 12/2008 | Duffy et al. | 60/605.2 |
| 7,469,691 | B2 * | 12/2008 | Joergl et al. | 60/605.2 |
| 7,520,273 | B2 * | 4/2009 | Freitag et al. | 60/605.2 |
| 7,587,888 | B2 * | 9/2009 | Shirakawa | 60/605.2 |
| 2008/0041051 | A1 * | 2/2008 | Silbermann et al. | 60/605.2 |
| 2008/0092861 | A1 * | 4/2008 | Duffy et al. | 60/605.2 |
| 2008/0223038 | A1 * | 9/2008 | Lutz et al. | 60/605.2 |
| 2009/0133385 | A1 * | 5/2009 | Ono | 60/605.2 |
| 2010/0186407 | A1 * | 7/2010 | Evans-Beauchamp | 60/605.1 |

FOREIGN PATENT DOCUMENTS

| | | | |
|---|---|---|---|
| JP | 59119009 | A * | 7/1984 |
| JP | 5-187329 | | 7/1993 |
| JP | 2001-207828 | | 8/2001 |

* cited by examiner

EXHAUST GAS RECIRCULATION SYSTEM FOR INTERNAL COMBUSTION ENGINE

CROSS-REFERENCE TO RELATED APPLICATION

This application is based upon and claims benefit of priority of Japanese Patent Application No. 2006-336620 filed on Dec. 14, 2006, the content of which is incorporated herein by reference.

BACKGROUND OF THE INVENTION

1. Field of the Invention

The present invention relates to an exhaust gas recirculation system for an internal combustion engine. The exhaust gas recirculation system is referred to as the EGR system in this specification.

2. Description of Related Art

An EGR system for recirculating part of exhaust gas of an internal combustion engine to an intake system has been known hitherto. Two types of the EGR systems have been used. One is a high pressure EGR system in which a high pressure exhaust gas exhausted from a combustion chamber is directly supplied to a downstream portion of a throttle. The other one is a low pressure EGR system in which exhaust gas (a relatively low pressure gas) passed through an exhaust gas cleaner is supplied to an upstream portion of a supercharger (refer to JP-A-5-187329).

In the low pressure EGR system, exhaust gas passed through a turbine of a supercharger and an air cleaner having catalysts is supplied to the upstream portion of the supercharger compressor in an intake pipe. If foreign particles are mixed with the exhaust gas in the turbine portion or the air cleaner portion in an exhaust pipe, the foreign particles enter into the compressor portion of the supercharger in the intake pipe. The foreign particles may cause a malfunction in the supercharger or in the engine.

In the low pressure EGR system shown in JP-A-5-187329, a filter having catalysts is disposed in a passage connecting an exhaust system and an intake system. Although carbon particles contained in the exhaust gas are burnt in the filter, relatively large particles contained in the exhaust gas cannot be removed in the filter. These particles may clog small passages in the filter. In addition, since the Filter contains catalysts, the filter is expensive.

SUMMARY OF THE INVENTION

The present invention has been made in view of the above-mentioned problem, and an object of the present invention is to provide an improved EGR system for an internal combustion engine, in which an amount of foreign particles entering into an intake system is suppressed.

The EGR system for an internal combustion engine includes a high pressure EGR system for recirculating part of exhaust gas from an upstream portion of an exhaust passage directly to a downstream portion of an intake passage and a low pressure EGR system for recirculating part of exhaust gas from a downstream portion of the exhaust passage to an upstream portion of the intake passage.

The low pressure EGR system includes a low pressure EGR passage connecting a downstream portion of an exhaust gas cleaner disposed in the exhaust passage to an upstream portion of a supercharger compressor disposed in the intake passage. In the low pressure EGR passage, a trapping device for trapping foreign particles contained in the exhaust gas and a valve for controlling an amount of gas flowing through the low pressure EGR passage.

Preferably, the trapping device is positioned lower than the low pressure EGR passage so that the foreign particles drop into the trapping device by their own weight. Further, a cross-sectional area of the trapping device is made larger than that of the low pressure EGR passage to reduce flow speed of the EGR gas in the trapping device so that the foreign particles are easily trapped in the trapping device. Malfunctions in the exhaust gas cleaner and in the supercharger may be electronically detected by detectors connected to an engine control unit. When such malfunctions are detected, the valve disposed in the low pressure EGR passage is closed to thereby prevent a large amount of foreign particles generated due to the malfunctions from entering the intake passage. When supply of the low pressure EGR gas is stopped in this manner, an amount of the high pressure EGR gas supplied to the intake passage is increased to thereby maintain a total amount of the EGR gas supplied to the engine at a desired level.

By providing the device for trapping foreign particles contained in the EGR gas in the low pressure EGR passage, the foreign particles are prevented from entering into the intake passage, or an amount of the foreign particles entering into the intake passage is reduced. Other objects and features of the present invention will become more readily apparent from a better understanding of the preferred embodiments described below with reference to the following drawings.

DETAILED DESCRIPTION OF THE PREFERRED EMBODIMENTS

A first embodiment of the present invention will be described with reference to FIGS. 1-3. The present invention is applied to an engine system for a Diesel engine in the embodiments. However, the present invention can be applied also to an engine system for a gasoline engine.

Figure 1:
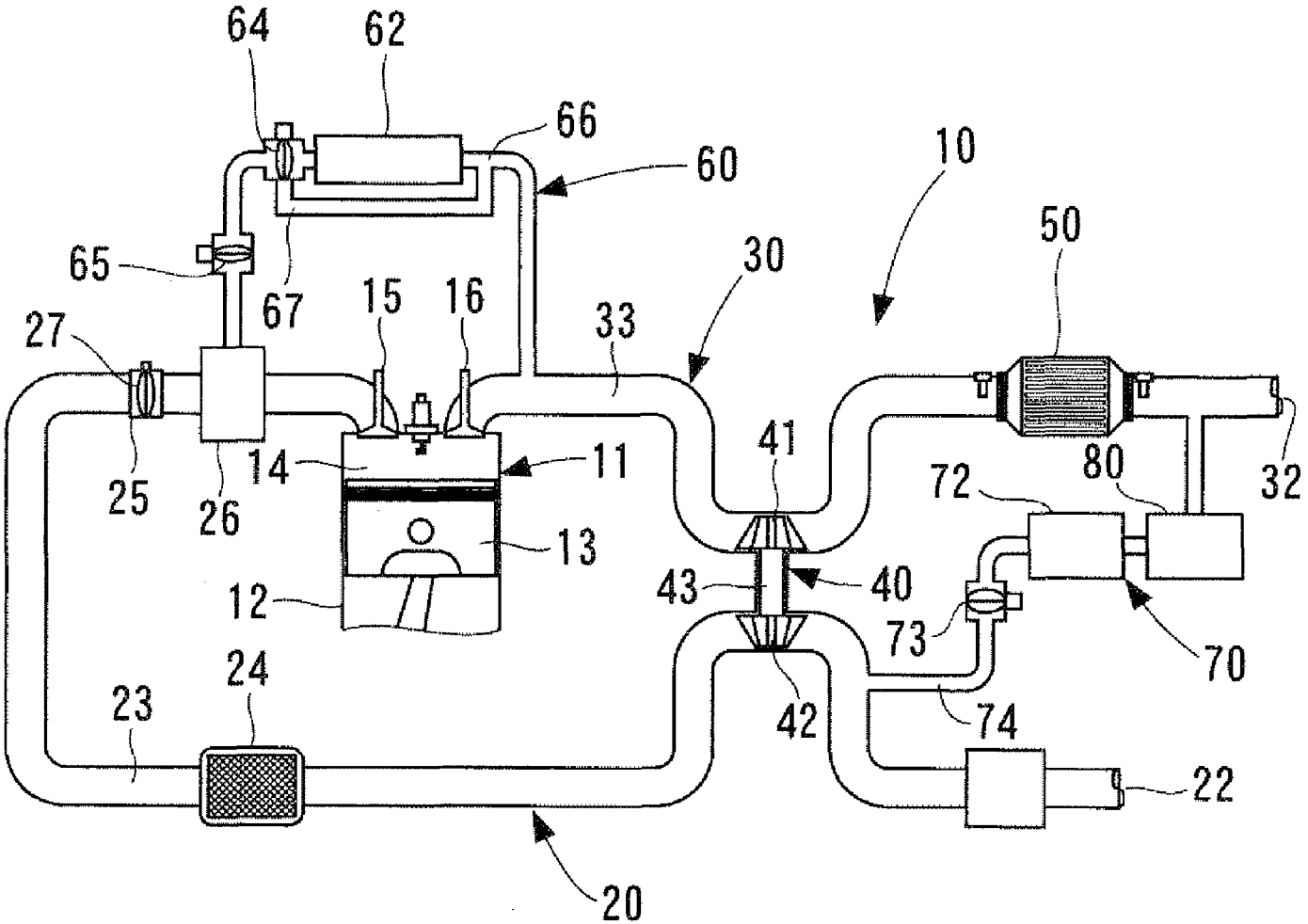
FIG. 1 is a drawing showing an entire structure of an engine system having an exhaust gas recirculation system as a first embodiment of the present invention.
Figure 2:
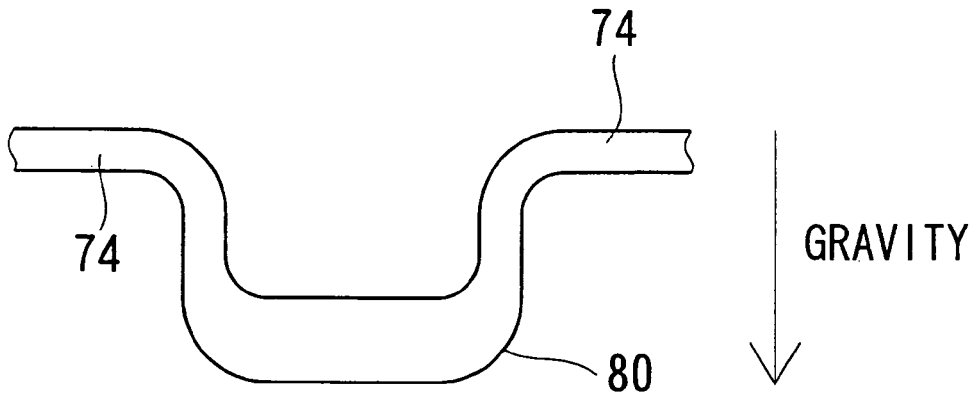
FIG. 2 is a schematic view showing a trapping device used in the exhaust gas recirculation system.

FIG. 1 shows an engine system 10. The engine system includes an engine 11, an intake system 20, an exhaust system 30, a supercharger 40, an exhaust gas cleaner 50, a high pressure EGR (Exhaust Gas Recirculation is referred to as EGR in this specification) system 60, and a low pressure EGR system 70. The engine 11 includes plural cylinders 12. Bach cylinder 12 has a piston 13 reciprocating in its axial direction, forming a combustion chamber 14 between the piston 13 and the cylinder 12.

The intake system 20 introduces air into the engine 11. The intake system 20 forms an intake passage 23 which is open outside at one end and connected to the combustion chamber 14 at the other end. In the intake passage 23, an intake port 22, a compressor 42 of the supercharger 40, an inter cooler 24, a throttle 25 having a throttle valve 27 and a surge tank 26 are disposed in this order from the intake port 22. Air is taken into the intake passage 23 through the intake port 22 and supplied to the combustion chamber 14 through an intake valve 15 that is open or closed in a controlled manner.

The exhaust system 30 exhausts exhaust gas from the engine 11 to the outside. The exhaust system 30 forms an exhaust passage 33 which is connected to the combustion chamber 14 at one end and open to the outside at the other end. In the exhaust passage 33, a turbine 41 of the supercharger 40 and the exhaust gas cleaner 50 are disposed in this order from the combustion chamber 14. The exhaust gas is taken out from the combustion chamber 14 through an exhaust valve 16 that is open or closed in a controlled manner and exhausted from the exhaust port 32.

The supercharger 40 is composed of a turbine 41 disposed in the exhaust passage 33 and a compressor 42 disposed in the intake passage 23. The compressor 42 is connected to the turbine 41 by a shaft 43. The turbine 41 is driven by the exhaust gas flowing through the exhaust passage 33, and thereby the compressor 42 pressurizes the air flowing through the intake passage 23. The pressurized intake air at a high temperature flowing through the intake passage 23 is cooled down by the inter-cooler 24. In this manner, air is supper-charged into the combustion chamber 14.

An amount of air supplied to the combustion chamber 14 is controlled by the throttle valve 27. The surge tank 26 is disposed between the throttle 25 and the combustion chamber 14. The intake air passing through the throttle 25 is distributed to each cylinder 12 of the engine 11 through the surge tank 26.

The exhaust gas cleaner 50 is disposed downstream of the turbine 41 of the supercharger 40. The exhaust gas cleaner 50 includes a Diesel Particulate Filter (DPF) in the diesel engine system or monolithic three-way catalysts, for example, in the gasoline engine system. The exhaust gas cleaner 50 may include plural filters and catalysts according to kinds of exhaust gas to be cleaned.

The high pressure ERG system 60 forms a high pressure EGR passage 66 which is connected to the exhaust passage 33 at one end and to the intake passage 23 through the surge tank 26 at the other end. Exhaust gas having a relatively high pressure and high temperature is branched out right after the combustion chamber 14 and recirculated into the combustion chamber 14 through the intake passage 23.

In the high pressure EGR passage 66, a cooler device 62 for cooling the EGR gas flowing through the high pressure EGR passage 66 is disposed. A bypass passage 67 is connected in parallel to the cooling device 62. At an downstream end of the cooling device 62, a control valve 64 is disposed. The control valve 64 controls an amount of the EGR gas flowing through both of the cooling device 62 and the bypass passage 67 to thereby control temperature of the EGR gas supplied to the combustion chamber 14. A high pressure EGR valve 65 disposed at a downstream portion of the high pressure EGR passage 66 controls an amount of the EGR gas supplied to the combustion chamber 14 through the intake passage 23. Thus, part of the exhaust gas is recirculated into the combustion chamber through the high pressure EGR passage 66.

The low pressure EGR system 70 forms a low pressure EGR passage 74. One end of the low pressure EGR passage 74 is connected to the exhaust passage 33 at a downstream end of the exhaust gas cleaner 50, and the other end thereof is connected to the intake passage 23 at an upstream portion of the compressor 42 of the supercharger 40. In the low pressure EGR passage 74, a trapping device 80, a cooling device 72, and a low pressure EGR valve 73 are disposed in this order. Part of the exhaust gas passed through the exhaust gas cleaner 50, which has a relatively low temperature and low pressure, is recirculated into the intake passage 23 through the low pressure EGR passage 74.

A trapping device 80 functions as a device for restraining foreign particles contained in the EGR gas therein. As shown in FIG. 2, the trapping device 80 is bent downward from the low pressure EGR passage 74, so that the foreign particles drop into the trapping device 80 by the gravitational force. A cross-section of the trapping device 80 is made larger than that of the low pressure EGR passage 74, so that a flowing speed of the EGR gas decreases in the trapping device 80, and thereby the foreign particles are easily trapped in the trapping device 80. As shown in FIG. 2, the trapping device 80 is a void that is free from filter media.

Figure 3:
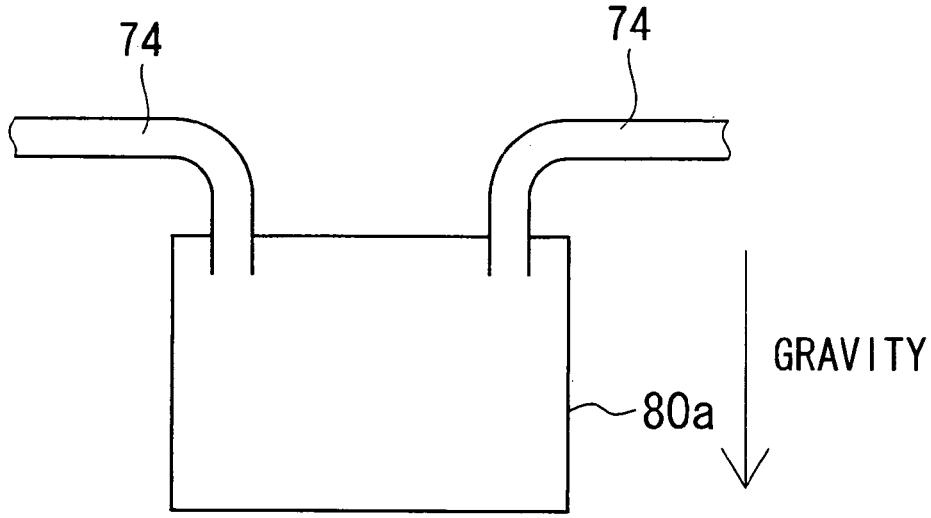
FIG. 3 is a schematic view showing another trapping device used in the exhaust gas recirculation system.

As shown in FIG. 3, a trapping device 80*a* may be formed in a box-shape. The trapping device 80*a* is positioned downwardly from the low pressure EGR passage 74 and has a larger cross-section than that of the low pressure EGR passage 74. The foreign particles contained in the EGR gas are easily trapped in the trapping device 80*a* because a flow speed of the EGR gas is reduced in the trapping device 80*a* and the foreign particles drop into the trapping device 80*a* by their own weight. As shown in FIG. 3, the trapping device 80*a* is a void that is free from filter media. The trapping device 80 or 80*a* shown above may be further modified.

The cooling device 72 disposed in the low pressure EGR passage 74 cools down the EGR gas flowing through the low pressure EGR passage 74. The low pressure EGR valve 73 controls an amount of EGR gas recirculated into the intake passage 23.

Advantages attained in the first embodiment described above will be summarized below. Since the foreign particles contained in the EGR gas are trapped by the trapping device 80 disposed in the low pressure ERG passage 74, foreign particles generated in the turbine 41 and the exhaust gas cleaner 50 due to some damages occurred therein are prevented from entering into the combustion chamber 14 through the intake passage 23. At least, an amount of such foreign particles entering into the intake passage 23 is reduced. Further, an amount of foreign particles entering into the cooling device 72 and the compressor 42 of the supercharger 40 is suppressed. Thus, stable operation of the engine 11 is secured. In addition, since the trapping device 80 (80*a*) has a larger cross-section and is positioned lower than the low pressure EGR passage 74, the foreign particles contained in the EGR gas are effectively restrained in the trapping device.

Figure 4:
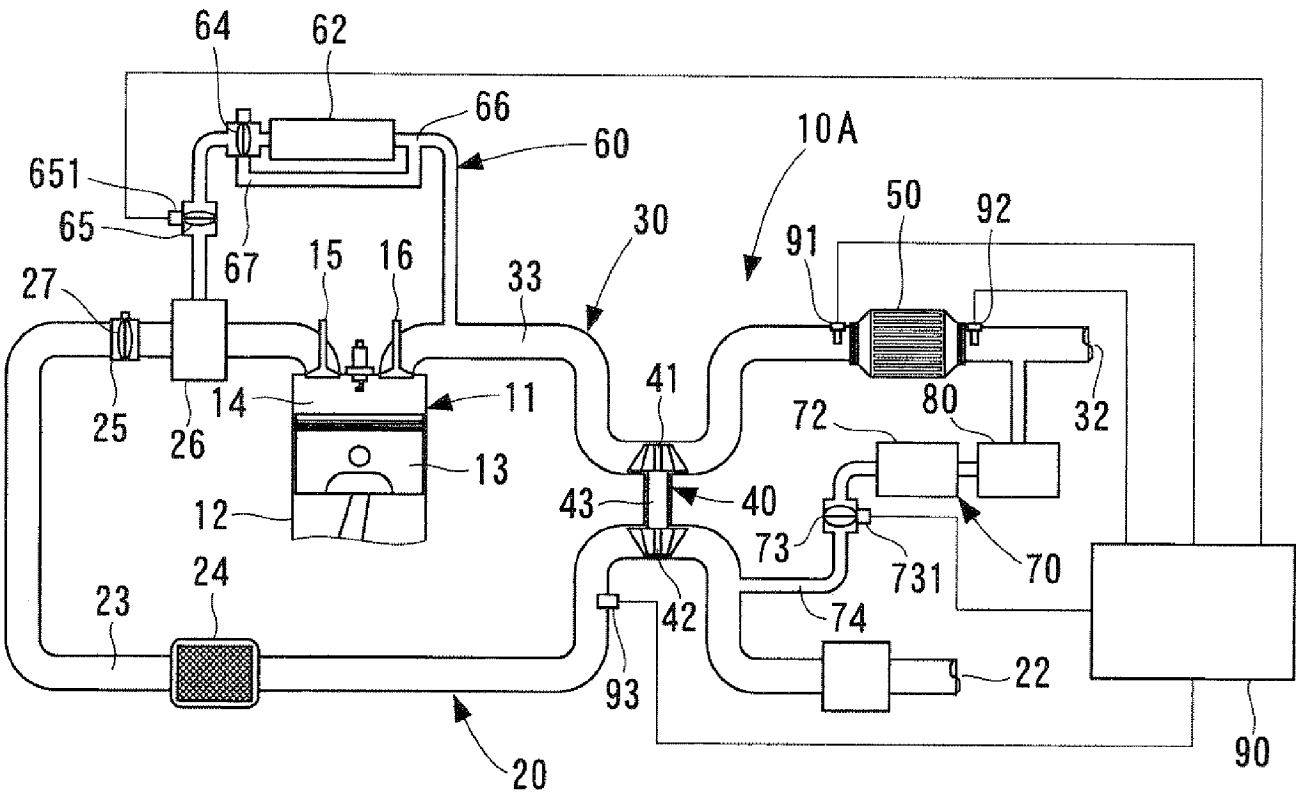
FIG. 4 is a drawing showing an entire structure of an engine system having an exhaust gas recirculation system as a second embodiment of the present invention.

With reference to FIG. 4, a second embodiment of the present invention will be described. In this embodiment, an electronic control unit (ECU) 90 and pressure sensors 91, 92 and 93 are additionally included in an engine control system 10A. The ECU 90 is composed of a microcomputer including a CPU, a ROM and a RAM. The ECU 90 controls an entire operation of the engine system 10A.

The pressure sensor 91 disposed at an upstream end of the exhaust gas cleaner 50 detects a pressure of the exhaust gas entering the exhaust gas cleaner 50 and sends an electrical signal representing the detected pressure to the ECU 90. The pressure sensor 92 disposed at an downstream end of the exhaust gas cleaner 50 detects a pressure of the exhaust gas flowing out from the exhaust gas cleaner 50 and sends an electrical signal representing the detected pressure to the ECU 90. The pressure sensor 93 disposed in the intake passage 23 at a downstream portion of the compressor 42 detects a pressure of the intake air supercharged by the supercharger 40 and sends an electrical signal representing the detected pressure to the ECU 90.

The ECU 90 calculates a pressure difference between the pressures detected by the pressure sensors 91 and 92. The ECU 90 detects a malfunction or a defect in the exhaust gas cleaner 50 based on the pressure difference. If small passages in the DPF or catalysts contained in the exhaust gas cleaner 50 are clogged, for example, the pressure difference exceeds a normal value. On the other hand, if the DPF or the catalysts are broken and passages therein are abnormally enlarged, the pressure difference becomes lower than a normal value. Therefore, the defects occurred in the exhaust gas cleaner 50 are detected based on the pressure difference.

The ECU 90 detects defects in the supercharger 40 based on the pressure detected by the pressure sensor 93. If the supercharger functions properly, the pressure detected by the pressure sensor 93 reaches a predetermined level which is determined according to a rotational speed of the engine 11. On the other hand, if the supercharger 40 does not function properly due to any damages or defects therein, the supercharged pressure detected by the pressure sensor 93 does not reach a predetermined level. Therefore, the defects or malfunction of the supercharger 40 are detected based on the pressure detected by the pressure sensor 93.

The high pressure EGR valve 65 is controlled by an actuator 651 which is in turn controlled by the ECU 90. The low pressure EGR valve 73 is controlled by an actuator 731 which is in turn controlled by the ECU 90.

Figure 5:
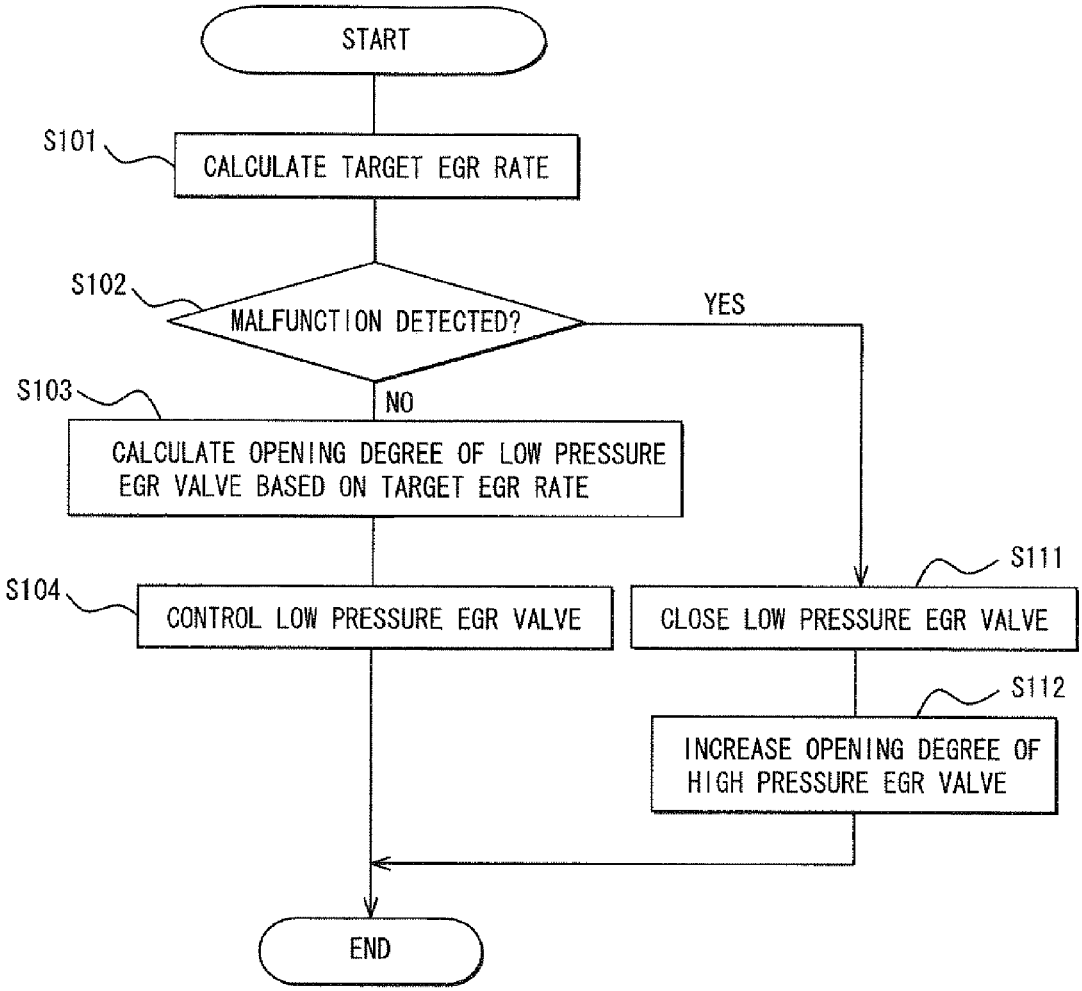
FIG. 5 is a flowchart showing a process of controlling the exhaust gas recirculation system (second embodiment).

With reference to FIG. 5 a process of controlling the low pressure and the high pressure EGR control systems will be described. At step 5101, the ECU 90 calculates a target EGR rate (a ratio of EGR gas amount relative to a total amount of exhaust gas) according to operating conditions of the engine 11 and an amount of fuel supplied to the engine 11. The operating conditions of the engine 11 are detected by various sensors (not shown) such as a rotational speed sensor, an acceleration sensor and a coolant temperature sensor. The amount of fuel supplied to the engine is calculated by the ECU 90 based on the operating conditions of the engine 11.

At step S102, whether a malfunction or defects occurred or not in the exhaust system 30 including the supercharger 40 is determined based on the pressure difference between the pressures detected by the pressure sensors 91 and 92 and the pressure detected by the pressure sensor 93. If no defect or malfunction is detected, the process proceeds to step S103. At step S103, a low pressure EGR rate (an EGR rate performed in the low pressure EGR system 70) is calculated, and an opening degree of the low pressure EGR valve 73 is calculated. That is, the ECU 90 calculates the low pressure EGR rate and a high pressure EGR rate (an EGR rate performed in the high pressure EGR system 70) based on the target EGR rate calculated at step S101.

Then, at step S104, the opening degree of the low pressure EGR valve 73 is set according to the calculated low pressure EGR rate. An amount of EGR gas recirculated through the low pressure EGR passage 74 is determined. At the same time, an opening degree of the high pressure EGR valve 65 is set according to the calculated high pressure EGR rate. An amount of EGR gas recirculated through the high pressure EGR system 60 is determined. In other words, the EGR rates in both systems are controlled so that a sum of the low pressure EGR amount and the high pressure EGR amount becomes equal to the target EGR amount.

If it is determined that defects or a malfunction occurred in the exhaust system 30 including the supercharger 40 at step S101, the process proceeds to step S111, where the low pressure EGR valve 73 is closed to shut off the low pressure EGR passage 74. Then, the process proceeds to step S112, where the opening degree of the high pressure EGR valve 65 is increased to compensate the shutting-off of the low pressure EGR and to secure the total target amount of EGR.

The following advantages are attained in the second embodiment in addition to the advantages attained in the first embodiment. Since the low pressure EGR valve 73 is closed when defects are found in the exhaust system 30 including the supercharger 40, foreign particles generated due to the defects are prevented from entering into the intake passage 23. Since the ECU 90 and the pressure sensors 91, 92, 93 are anyway used in the engine system, the foreign particles are prevented from entering into the intake passage without increasing the number of parts and components used in the engine system.

While the present invention has been shown and described with reference to the foregoing preferred embodiments, it will be apparent to those skilled in the art that changes in form and detail may be made therein without departing from the scope of the invention as defined in the appended claims.

What is claimed is:

1. An exhaust gas recirculation system for an internal combustion engine having an intake passage and an exhaust passage, comprising:

a supercharger driven by an exhaust gas flowing through the exhaust passage;

an exhaust gas cleaner, disposed in the exhaust passage, for cleaning exhaust gas; and a low pressure exhaust gas recirculation system including: a low pressure exhaust gas recirculation passage connecting a downstream portion of the exhaust gas cleaner in the exhaust passage to an upstream portion of the supercharger in the intake passage; and a device for trapping foreign particles contained in exhaust gas to thereby restrain the foreign particles from entering into the intake passage through the low pressure exhaust gas recirculation passage, wherein the foreign particles trapping device is disposed in the low pressure exhaust gas recirculation passage, the trapping device is positioned vertically lower, with respect to a direction of gravitational force, than a remainder of the low pressure exhaust gas recirculation passage, so that the foreign particles drop by gravitational force into the trapping device, the trapping device is a void that is free from filter media, the low pressure exhaust gas recirculation passage includes first and second passage segments, which extend in the direction of gravitational force, and the trapping device is arranged between the first and second passage segments and is connected to vertically lowermost portions of the first and second passage segments.

2. The exhaust gas recirculation system as in claim 1, wherein the trapping device has a cross-section larger than that of the remainder of the low pressure exhaust gas recirculation passage with respect to a flow direction of the exhaust gas flowing through the low pressure exhaust gas recirculation passage.

3. The exhaust gas recirculation system as in claim 1, wherein:

the low pressure exhaust gas recirculation system further includes a valve for controlling an amount of exhaust gas passing through the low pressure exhaust gas recirculation passage, a control unit, and detector means for detecting a malfunction in the exhaust gas cleaner or the supercharger; and the control unit operates the valve to close the low pressure exhaust gas recirculation passage when the malfunction in either the exhaust gas cleaner or the supercharger is detected by the detector means.

4. The exhaust gas recirculation system as in claim 3, wherein the malfunction of the exhaust gas cleaner is detected based on a pressure difference between an upstream portion and a downstream portion of the exhaust gas cleaner.

5. The exhaust gas recirculation system as in claim 3, wherein the malfunction of the supercharger is detected based on an intake air pressure supercharged by the supercharger.

6. The exhaust gas recirculation system as in claim 1, wherein an amount of exhaust gas recirculated through the low pressure exhaust gas recirculation passage is controlled according to operating conditions of the internal combustion engine.

7. The exhaust gas recirculation system as in claim 1, further including a high pressure exhaust gas recirculation system for recirculating part of exhaust gas having a relatively high pressure from an upstream portion of the exhaust passage directly to a downstream portion of the intake passage.

* * * * *